US005451032A

United States Patent [19]

Rhoads

[11] Patent Number: 5,451,032

[45] Date of Patent: Sep. 19, 1995

[54] DUAL PURPOSE CRANE BLOCK

[75] Inventor: Stanely E. Rhoads, Huntington Beach, Calif.

[73] Assignee: BC Industrial Supply, Inc., Orange, Calif.

[21] Appl. No.: 124,950

[22] Filed: Sep. 22, 1993

[51] Int. Cl.[6] ..... B66D 3/08; B66C 1/34

[52] U.S. Cl. ..... 254/399; 254/403; 294/82.11

[58] Field of Search ..... 254/402, 403, 411, 399; 294/82.1, 82.11

[56] References Cited

U.S. PATENT DOCUMENTS

| | | | |
|---|---|---|---|
| 113,688 | 4/1871 | Norcross . | |
| 691,492 | 1/1902 | Roney . | |
| 1,671,435 | 5/1928 | McKissick . | |
| 2,502,570 | 4/1950 | Johnson . | |
| 2,710,767 | 6/1955 | Howe | 294/82.1 |
| 3,917,334 | 11/1975 | Koster . | |
| 4,542,884 | 9/1985 | Dodge, Jr. . | |
| 4,641,875 | 2/1987 | Speich . | |
| 4,697,790 | 10/1987 | Yang . | |
| 5,154,401 | 10/1992 | Schramm et al. . | |

FOREIGN PATENT DOCUMENTS

| | | | |
|---|---|---|---|
| 182745 | 7/1922 | United Kingdom | 294/82.11 |

*Primary Examiner*—Daniel P. Stodola
*Assistant Examiner*—Michael R. Mansen
*Attorney, Agent, or Firm*—Harold L. Jackson

[57] ABSTRACT

A dual mode crane block is disclosed which crane block includes a sheave mounted therein and a cable retaining member mounted thereon. A hoisting cable can be routed around the sheave to double the lifting capacity of a crane. Otherwise, by way of the cable retaining member, the crane block can be suspended on the ends of a hoisting cable to serve as a weight.

3 Claims, 2 Drawing Sheets

FIG. 4
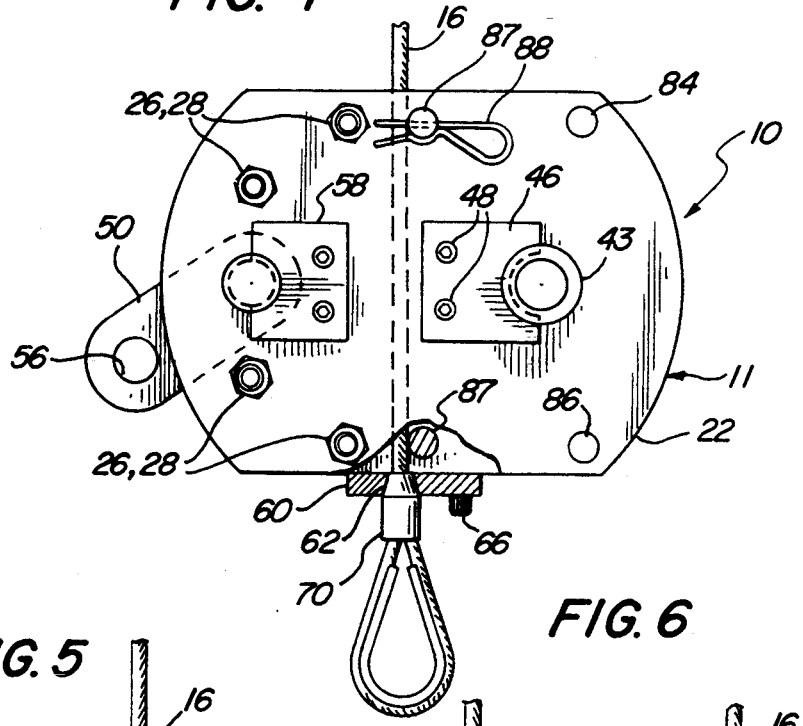
FIG. 5
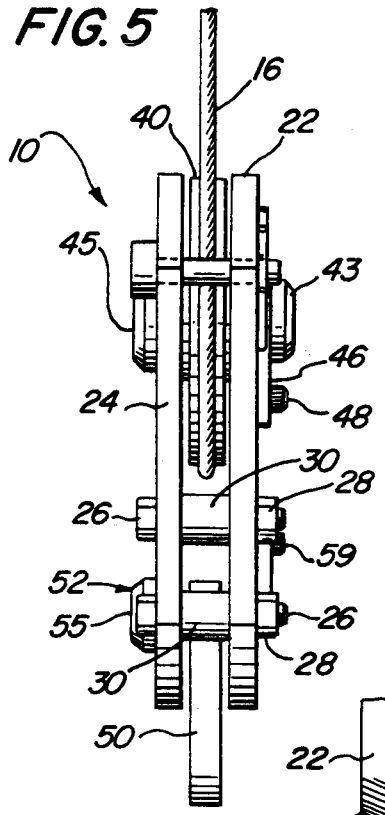
FIG. 6
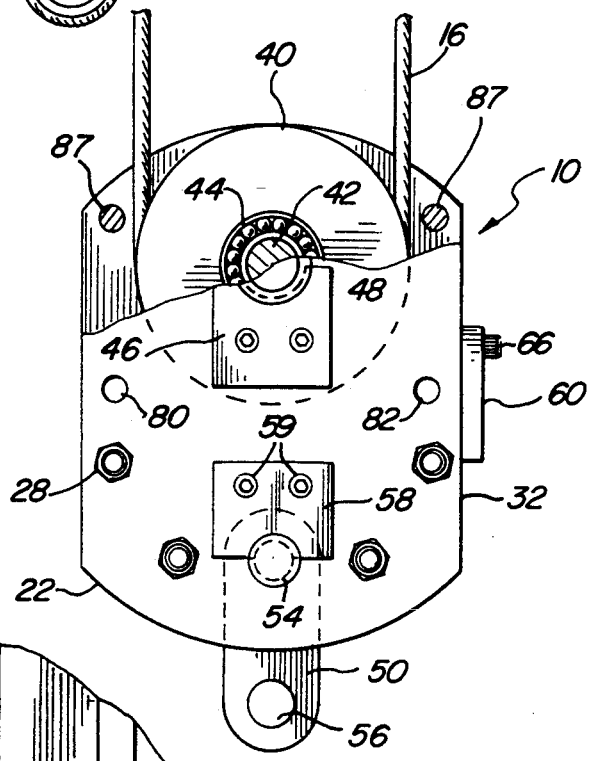
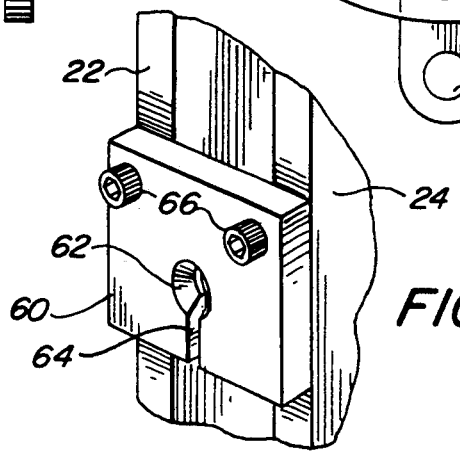
FIG. 7

DUAL PURPOSE CRANE BLOCK

BACKGROUND OF THE INVENTION

1. Field of the Invention

The invention relates generally to lifting apparatus and more particularly to crane blocks.

2. Description of Related Art

Cranes have been used for mechanically lifting objects of all shapes, sizes and weight for centuries. Historically, cranes have included a boom and a pulley attached at the end of the boom. A rope or cable routed over the pulley is attached to an object to be lifted. In some cases, doubling pulleys are used in a lifting operation, as exemplified in U.S. Pat. No. 691,492 issued to Roney in 1902. By doubling the cable on two pulleys, the lifting burden can be eased to enable a crane to handle heavier objects more readily. Such pulley arrangements are also illustrated in U.S. Pat. No. 1,671,435 issued to McKissick in 1927 and U.S. Pat. No. 2,502,570 issued to Johnson in 1950.

Contemporary lifting cranes typically have a cable with a hook and a heavy ball combination attached thereto. The heavy ball serves as a weight at the end of the cable to help pull the cable out when there is no object attached to the cable. In telescoping boom type cranes, a weight at the end of the cable assists the cable when the boom is being retracted or extended. Cranes for lifting medium to heavy objects also have included crane blocks attached to the end of a crane hoisting cable. A hook is attached to the crane block which hook is coupled with straps, rings or ropes attached to the object to be moved. U.S. Pat. No. 3,917,334 issued to Koster illustrates an example of a type of crane block. Koster discloses a snatch block which has a pair of side plates, sheave plates therebetween, liner plates between the sheave plates, and spacers and pins to hold this plate combination together. A cable is attached to one of the pins while the other pin serves to support a large hoisting hook. Koster's snatch block can also be used with a sheave to double the lifting capacity of a crane. However, complete disassembly of his block and change of many parts is required to make this switch. Accordingly, disadvantageously Koster's crane block can only be used in a single mode, as it is easier to have two of his snatch blocks available at a lifting site rather than to interchange the sheave and lifting pin.

Other crane block arrangements are illustrated in U.S. Pat. No. 4,697,790 issued to Yang and U.S. Pat. No. 5,154,401 issued to Schramm et al. Yang discloses a pulley hoist including a hook with U-shaped anchor brackets and a sheave rotatably mounted between the legs on a shaft therebetween. A rope or cable from a power unit extends around the sheave and is hooked back onto the power unit.

Scramm et al. discloses a marine block for raising, lowering or adjusting sails which includes a fixed or swivel head, shackle and a ground and polished axle composed of 17-4 ph stainless steel sandwiched between titanium/titanium alloy side cheeks. An aluminum sheave with filament wound epoxy glass redial bushing with Teflon (TM) liner slide over the axle. Oven cured Teflon (TM) filled thrust washers bonded to the sides of the sheave turn against polished inner surfaces of the side cheeks. This arrangement provides a corrosion resistant block for use in competition sailing.

These cable block arrangements can only be used in a single mode capacity. A versatile crane block arrangement that can be used in a cable doubling arrangement or in a cable weighting arrangement would provide an advancement in the art.

SUMMARY OF THE INVENTION

It is therefore an object of the invention to provide a crane block structure that can be easily switched between single or double cable lifting capacity or modes.

It is another object of the invention to provide a crane block structure that is simple, yet strong and reliable.

It is still a further object of the invention to provide a crane block structure with a minimum number of parts.

It is an advantage of the invention that the crane block structure of the present invention can be readily switched between single and double lifting capacity or modes by the simple removal of guide pins and re-routing a hoisting cable without need to disassemble the entire crane block.

A crane block according to the present invention includes a frame body with a sheave rotatably suspended therebetween. Hook attachment means is provided for coupling a hoisting hook to the frame body. When a cable is routed around the sheave, the crane block can be used to hoist objects with double the lifting capacity. A cable suspending member is attached the frame body of the crane block. Alternatively, the cable can be routed through the frame body and seated on the cable suspending member such that the crane block hangs on the hoisting cable. In this position, the crane block serves as an overhaul weight on the end of the cable.

BRIEF DESCRIPTION OF THE DRAWINGS

FIG. 4 is a more detailed front view of the crane block showing the crane block suspended on the end of a hoisting cable.

FIG. 5 side view the crane block showing a hoisting cable routed around the sheave;

FIG. 6 is a partially broken away front view of the crane block, and

FIG. 7 is a partial view illustrating more closely the cable retaining member of the present invention.

DESCRIPTION OF THE PREFERRED DRAWINGS

Figure 1:
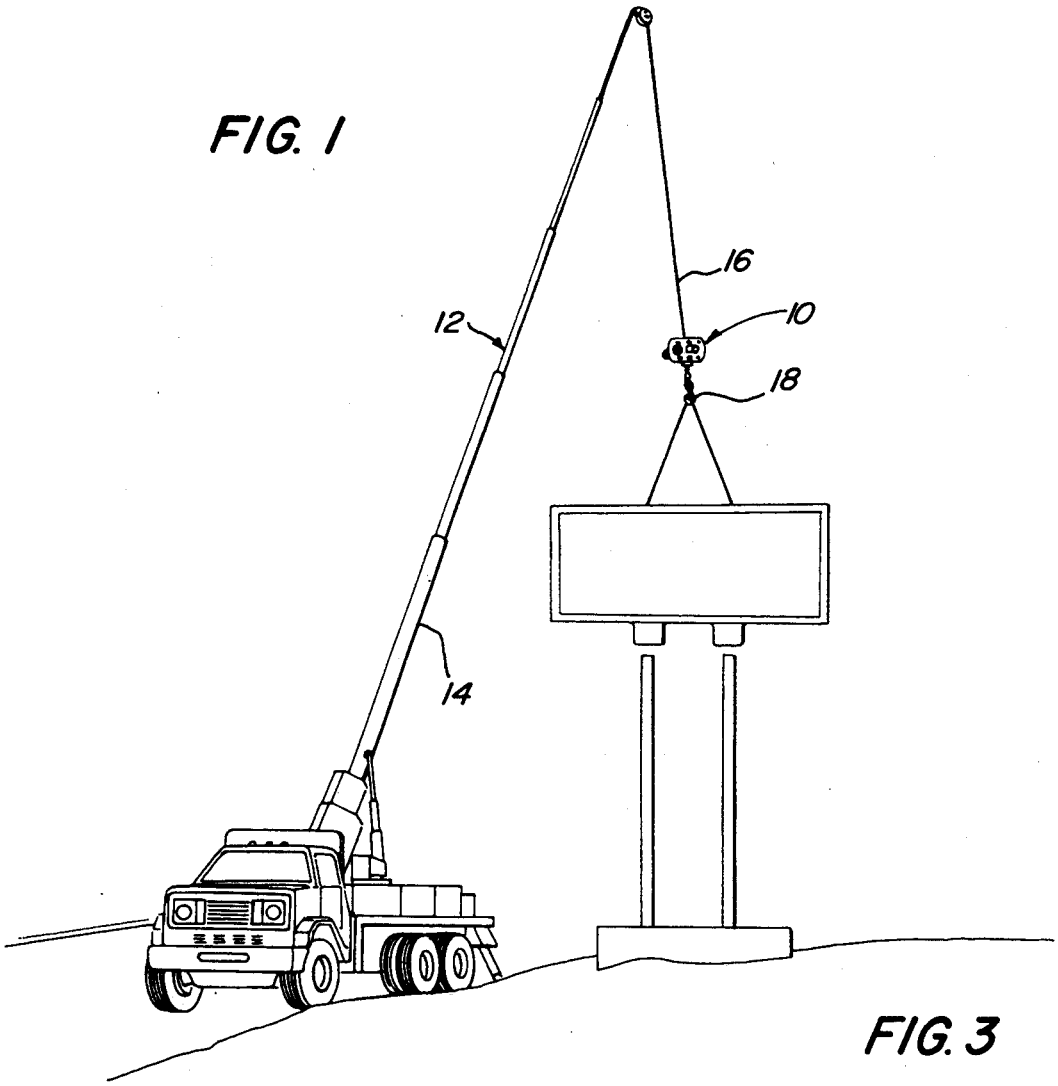
FIG. 1 is a pictorial view of a boom crane employing the crane block of the present invention.

Referring now with more particularity to the drawings, wherein like or similar parts are designated by the same or primed numerals throughout the various figures, a crane block structure 10 is illustrated in FIGS. 1–7. In FIG. 1, a boom type crane 12 is shown being carried on a truck having a projecting moveable arm 14 by which heavy objects can be lifted, moved and placed. The boom crane 12 has a hoisting cable 16 which is typically made of wire rope and a lifting hook 18 attached to the end of the hoisting cable. Crane block structure 10 is shown as being suspended on the end portion of the hoisting cable 16. The boom crane 12 may be employed to lift various objects such as crates, construction materials, or signs (as illustrated here). Many other types of cranes or lifting apparatus exit or may be developed which can employ the crane block structure 10 of the present invention, such as stationary lifting cranes, and this invention is not limited to any particular type of crane or lifting system.

The construction of crane block 10 is shown with more particularity in FIGS. 4–6. Crane block 10 comprises a frame body 11 which may include a pair of side plates 22, 24 which plates are typically of similar size and shape. In this embodiment, the side plates 22, 24 each have two rounded ends with two side edges therebetween. Side plates 22, 24 are affixed together in a face to face, spaced parallel relationship by bolts 26, nuts 28 and spacers 30. The open space between side plates 22, 24 is sufficient for a hoisting cable 16 to be routed therethrough. The side edges of plates 22, 24 are essentially parallel forming at least on one side of the crane block 10 a flat mounting surface area 32.

Referring with more particularity to FIGS. 5 and 6, a pulley or sheave 40 is rotatably mounted in the frame body 11 between side plates 22, 24 on sheave pin or axle 42, which sheave pin is transversely disposed through and secured to the side plates by heads 43 and 45 disposed on the ends of the sheave pin 42. The sheave 40 contains a hub bearing 44 to provide for easier spinning of the sheave on the sheave pin 42. The sheave 40 is preferably located between the side plates 22, 24 near one of the two ends, but such that the sheave does not stick out beyond the end of the two side plates. A sheave pin retaining plate 46 is mounted by means of bolts 48 onto the outside surface of one of the side plates under one of the heads 43. The retaining plate 46 may be notched to mate with a notch in the sheave pin 42, which keeps the sheave pin 42 from turning.

Near the other end of the crane block structure 10, hook strap 50 is pivotally mounted between side plates 22, 24 by axle bolt 52 and heads 54 and 55. Hook strap 50 is shown as an elongated plate member with a hole 56 at one end for coupling a lifting hook 18. Retaining member 58 is mounted by means of bolts 59 to the outside of the two side plates under one of the heads 54, and as above, the retaining plate may be cooperatively notched with the axle bolt 52, to keep axle bolt in place and prevent it from turning. The hook strap is restricted from pivoting between side plates 22, 24 by spacers 30, and therefore will not interfere with the hoisting cable 16 when the crane block structure 10 is being employed as a weight.

Crane block 10 may be employed as a weight at the end of a hoisting cable by suspending the crane block 10 on the end of the cable by means of the cable retaining member 60. As shown in FIG. 7, the cable retaining member 60 is preferably sized to extend on the flat surface area 32 of the side plates 22, 24 and is secured thereto by bolts 66. Cable retaining member 60 is bolted along each side of the frame body 11. Cable retaining member 60 may be a small plate having a chamfered hole 62 therethrough with a slot 64 extending from the hole 62 through an edge of the retaining member. See FIG. 7. The hole 62 is shaped to receive the end portion of the hoisting cable. The cable retaining member and its hole 62 are placed along the extent of the side edges of side plates 22, 24 along the center of gravity, so that when crane block structure 10 is suspended from a hoisting cable 16 the crane block structure will hang transversely with respect to the cable and the end of the hoisting cable will extend downwardly. Consequently, a hoisting hook 18 attached to the hoisting cable will extend downwardly which is desired for a typical lifting operation.

The hole 62 in the cable retaining member 60 for this particular embodiment is shaped to retain a swaged rope thimble 70. A conventional hoisting cable 16, as illustrated in this example, typically is made of wire rope and has a loop 72 formed at the end of the cable which is closed by means of a swaged rope thimble 70. The swaged rope thimble 70 typically has a frustoconically shaped end portion extending upwardly along the hoisting cable. Accordingly, in this particular embodiment, the hole 62 is a countersunk hole which conforms to and accepts such swaged rope thimble 70.

The hoisting cable 16 is retained in its respective positions or modes by guide pin means comprising a first pair of spaced holes 80 and 82 extending through the side plates adjacent the periphery of the sheave and a second pair of spaced holes 84 and 86 extending through the side plates along a line parallel to and adjacent the cable when its end 70 is positioned in the cable retaining hole 62 as is illustrated in FIG. 4. A pair of guide pins 87 are selectively positioned in the first or second pair of holes and secured therein by pin retainers 88, which may be cotter pins or other spring pins. Guide pins 87 can be easily removed and reinserted to reposition a hoisting cable 16 with respect to the cable block structure 10.

Figure 2:
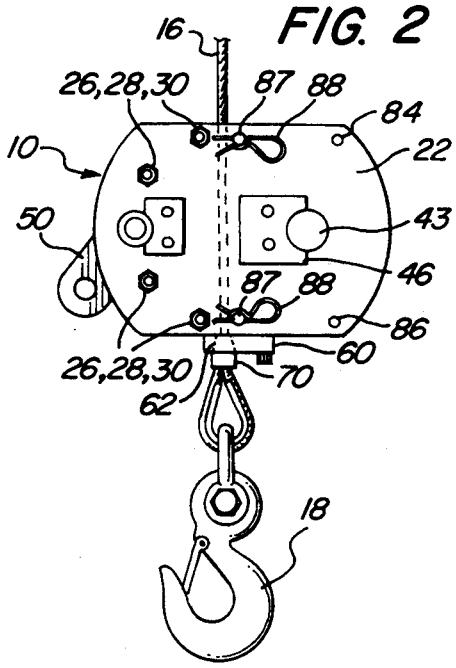
FIG. 2 is a front view of the crane block of the present invention wherein the crane block is used in a weighting capacity.
Figure 3:
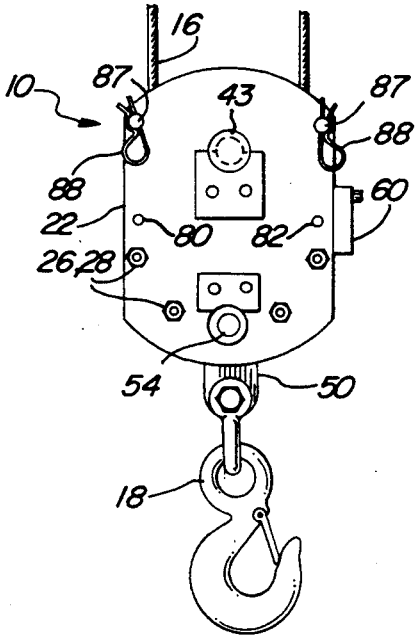
FIG. 3 is a front view of the crane block of the present invention employing a sheave to double the lifting capacity of a hoisting cable.

FIGS. 2 and 3 illustrate two positions or modes for cable block structure 10 of the present invention. As shown in FIG. 2, cable block structure 10 can be suspended on the end of hoisting cable 16. The hoisting cable 16 is retained by the guide pins 87 (within holes 80 and 82) on one side thereof and spacers 30 along the other side of the hoisting cable 16. In this position, crane block structure 10 serves as an overhaul weight at the end of hoisting cable 16. The boom of a hoisting crane employing this crane block can be extended or retracted, or the hoisting cable itself extended or retracted more readily. The positions or modes of the crane block structure 10 can be changed by simply removing guide pins 87 from the holes, pulling hoisting cable 16 through the side plates 22, 24 of crane block structure 10 around sheave 40, as illustrated in FIGS. 3 and 6. A hoisting hook 18 is attached to the hole 56 in hook strap 50. In this mode, the hoisting cable is doubled back to a dead end adjacent the point sheave on the crane (not shown) and the lifting capacity of the crane is doubled. Guide pins 87 inserted into holes 84 and 86 aid in the retention of the hoisting cable 16 on the sheave 40.

The above-described detailed description of a preferred embodiment described the best mode contemplated by the inventors for carrying out the present invention at the time this application was filed and is offered by way of example and not by way of limitation. Accordingly, various modification may be made to the above-described preferred embodiment without departing from the scope of the invention. Accordingly, it should be understood that although the invention has been described and shown for a particular embodiment, nevertheless various changes and modifications obvious to a person of ordinary skill in the art to which the invention pertains are deemed to lie within the spirit and scope of the invention as set forth in the following claims.

What is claimed is:

1. A dual purpose crane block for hoisting cables, comprising:

a frame body comprising two parallel plates having front and back major surfaces with an open space therebetween, the plates further having two ends and side edges therebetween;

a sheave rotatably mounted in the open space, a cable retaining flat plate affixed along one of the side edges of the plates of the frame body and having a conically-shaped hole therein for receiving the hoisting cable such that the frame body can be suspended on the hoisting cable, the hole having a slot extending to the edge of the cable retaining flat plate;

the frame body plates having a first pair of spaced holes extending therethrough adjacent the periphery of the sheave and a second pair of spaced holes extending therethrough along a line extending parallel to and adjacent the cable when the cable is inserted in the cable retaining plate; and a pair of guide pins for selective placement in the first or second pair of holes in the frame body plates whereby the cable is maintained within the sheave when the guide pins are placed in the first pair of holes and within the cable retaining plate when the guide pins are placed in the second pair of holes.

2. A dual purpose crane block for hoisting cables, comprising:

two side plates mounted together in a spaced relationship;

a sheave mounted therebetween;

a hook mounting member pivotally mounted between the two plates for attaching a hoisting hook to the two side plates, the hook mounting member being in the form of an elongated plate with a hole therein for mounting a hoisting hook;

a cable retaining member mounted on the two side plates for mounting the crane block on the hoisting cable, the cable retaining member comprising an elongated plate having a conically-shaped hole and a slot therein;

guide pin means extending between the two plates for selectively positioning a hoisting cable around the sheave or to the cable retaining plate; and guide pin means including a first pair of spaced holes extending through the plates adjacent the periphery of the sheave and a second pair of spaced holes extending through the plates along a line extending parallel to and adjacent the cable when the cable is inserted in the cable retaining member, the guide pin means further including a pair of guide pins for selective placement in the first or second pair of holes whereby the cable is maintained within the sheave when the guide pins are placed in the first pair of holes and within the cable retaining member when the guide pins are placed in the second pair of holes.

3. A dual purpose crane block for hoisting cables, comprising:

two side plates mounted together in a spaced relationship;

a sheave rotatably suspended between said two side plates;

an elongated plate member with an aperture pivotally mounted between the side plates;

a cable retaining member attached to the side plates for suspending the crane block on the hoisting cable, the cable retaining member having a conically-shaped hole with a slot extending therefrom; and a pair of removable guide pins extending between the two plates for selectively guiding a hoisting cable around the sheave or to the cable retaining plate.

* * * * *